US008342428B2

(12) United States Patent
Chu

(10) Patent No.: US 8,342,428 B2
(45) Date of Patent: Jan. 1, 2013

(54) REFILLABLE SPRAYER

(76) Inventor: Bo-Lang Chu, Taichung (TW)

( * ) Notice: Subject to any disclaimer, the term of this patent is extended or adjusted under 35 U.S.C. 154(b) by 467 days.

(21) Appl. No.: 12/487,975

(22) Filed: Jun. 19, 2009

(65) Prior Publication Data

US 2010/0320286 A1 Dec. 23, 2010

(51) Int. Cl.
*B05B 7/32* (2006.01)

(52) U.S. Cl. ..... 239/337; 239/303

(58) Field of Classification Search ..... 239/302–304, 239/307, 308, 310, 337, 338, 569, 352, 367; 222/562, 568, 545; 220/255, 256.1, 259.1, 220/228

See application file for complete search history.

(56) References Cited

U.S. PATENT DOCUMENTS

| | | | | |
|---|---|---|---|---|
| 2,374,430 | A * | 4/1945 | Hexter | 177/70 |
| 3,507,309 | A * | 4/1970 | Johnson | 141/18 |
| 5,107,893 | A * | 4/1992 | Adkins | 137/599.12 |
| 6,938,805 | B2 * | 9/2005 | Brincat | 222/568 |
| 7,051,907 | B2 * | 5/2006 | Brincat | 222/568 |
| 2003/0102335 | A1 * | 6/2003 | Barnett | 222/386.5 |
| 2008/0128145 | A1 * | 6/2008 | Butz et al. | 169/46 |

* cited by examiner

*Primary Examiner* — Davis Hwu
(74) *Attorney, Agent, or Firm* — C. G. Mersereau; Nikolai & Mersereau, P.A.

(57) ABSTRACT

A refillable sprayer has a can, a spray nozzle, a gas filling valve and a release valve. The can is hollow and has a top casing and a bottom casing. The bottom casing is combined detachably with the top casing. The spray nozzle is mounted through the can. The gas filling valve is mounted on the can.

2 Claims, 7 Drawing Sheets

REFILLABLE SPRAYER

BACKGROUND OF THE INVENTION

1. Field of the Invention

The present invention relates a sprayer, and more particularly to a refillable sprayer.

2. Description of Related Art

A sprayer can be used to spray different kinds of oils. With reference to FIG. 4, a conventional sprayer (60) has pressurized gas and oil at a suitable ratio, such that the oil can be uniformly sprayed by the pressurized gas. However, a conventional sprayer (60) is not refillable so is not environmentally friendly and once the pressurized gas is depleted oil remaining in the sprayer (60) is wasted.

With further reference to FIGS. 5 to 7, a conventional refillable sprayer assembly (70) comprises a can (71), a spray nozzle (72), a filling container (73) and a gas supplying tube (74). The can (71) is hollow and has a gas filling valve (711), a bottom surface and an opening. The gas filling vale (711) is mounted on the bottom surface of the can (71). The spray nozzle (72) is mounted on the opening of the can (71). The filling container (73) has a filling space and a connector. The filling space is defined in the filling container (73) and contains oil inside. The filling space is designed to have a volume corresponding to a volume of oil the can (71) can hold. The connector is mounted on the bottom of the filling container (73) and connected to the can (71). The gas supplying tube (74) has multiple notches (742) and is connected to the gas filling valve (711).

When the oil in the can (71) is empty, the oil is added into the can (71) from the filling container (73) through the connector. Because the volume of the filling space corresponds to that of the oil applied for the can (71), the amount of the oil supplied into the can (71) is fixed as required.

To add pressurized gas into the can (71), the gas supplying tube (74) is connected between the gas filling valve (711) and a gas pump, so pressurized air can be filled into the can (71) from the gas pump via the gas supplying tube (74) and the gas filling valve (711). When the gas pressure in the can (71) achieves a desired level, redundant gas supplied from the gas pump is exhausted through the notches (742).

However, the conventional refillable sprayer assembly (70) needs a specific gas supplying tube (74) and the filling container (73) to fill the gas and the oil into the can (71) so is inconvenient in use.

To overcome these shortcomings, the present invention provides a refillable sprayer to mitigate or obviate the aforementioned problems.

SUMMARY OF THE INVENTION

A refillable sprayer has a can, a spray nozzle, a gas filling valve and a release valve. The can is hollow and has a top casing and a bottom casing. The bottom casing is combined detachably with the top casing. The spray nozzle is mounted through the top casing. The gas filling valve is mounted on the can. Therefore, special components for filling the oil and the gas into the can are unnecessary so improving convenience of refilling the sprayer.

Other objects, advantages and novel features of the invention will become more apparent from the following detailed description when taken in conjunction with the accompanying drawings.

DETAILED DESCRIPTION OF PREFERRED EMBODIMENT

Figure 1:
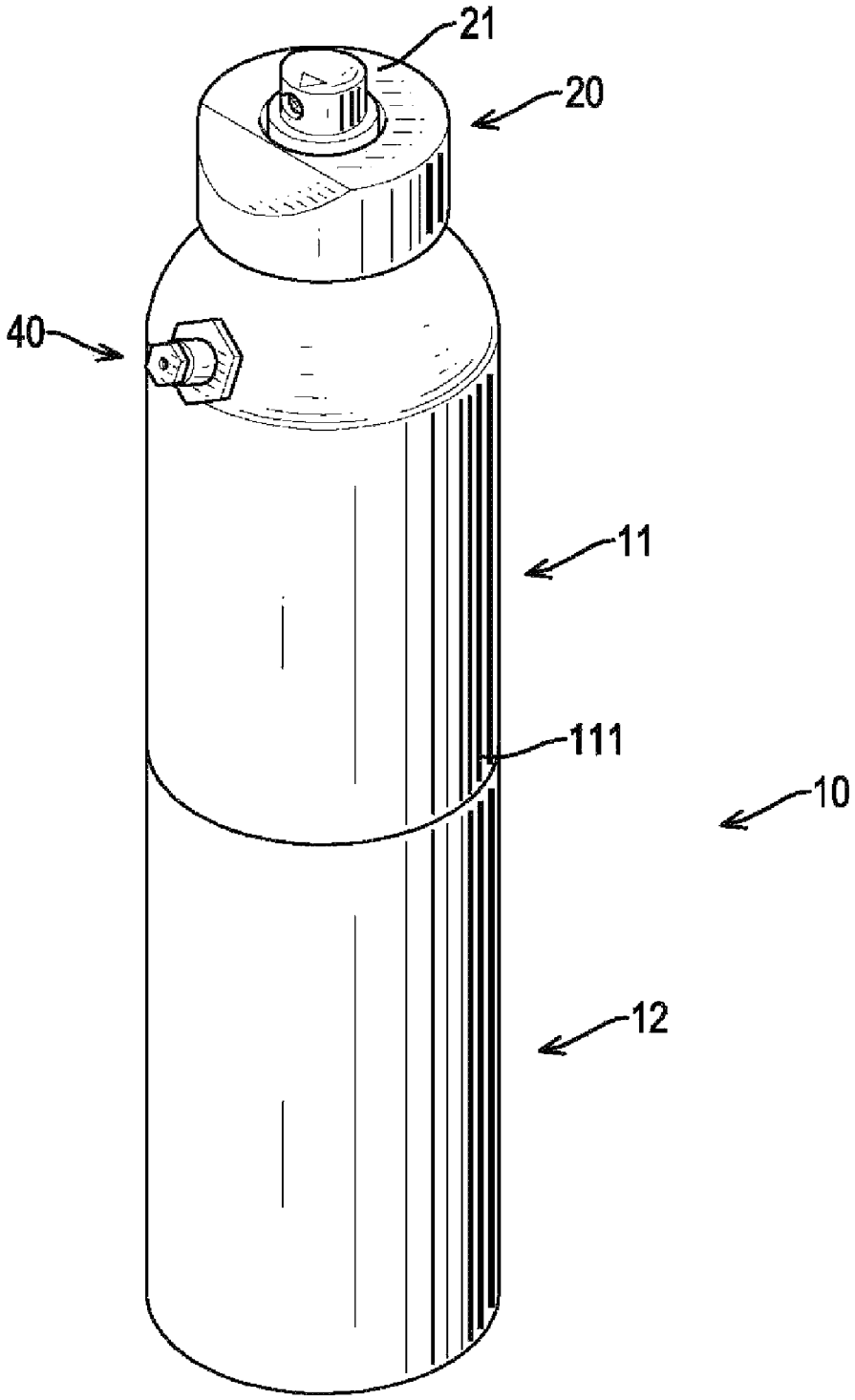
FIG. 1 is a perspective view of a refillable sprayer in accordance with the present invention.
Figure 2:
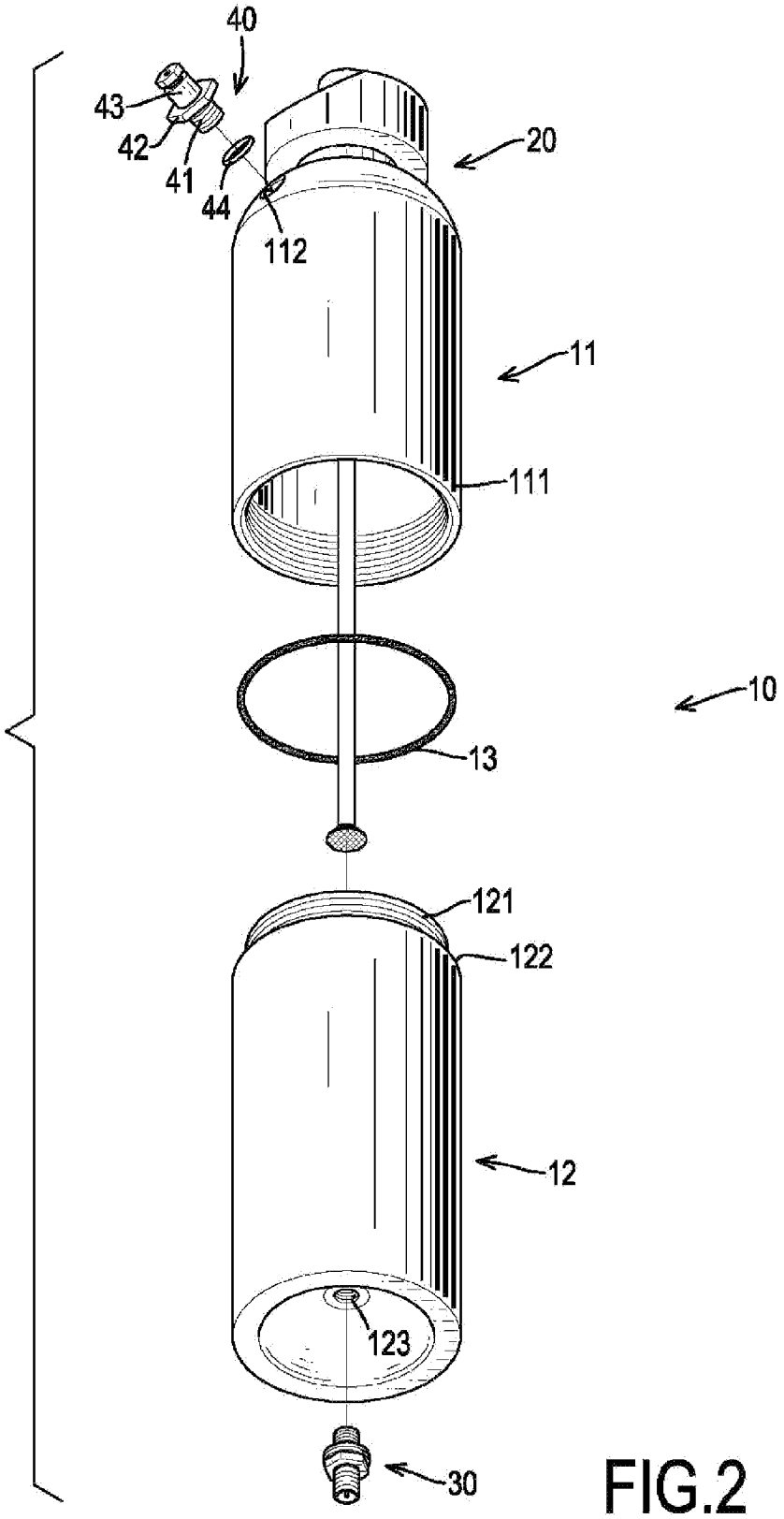
FIG. 2 is an exploded perspective view of the sprayer in FIG. 1.

With reference to FIGS. 1 and 2, a refillable sprayer in accordance with the present invention comprises a can (10), a spray nozzle (20), a gas filling valve (30) and a release valve (40).

The can (10) is hollow and detachable into multiple components and may comprise a top casing (11), a bottom casing (12) and an O-ring (13). The top casing (11) has a first connecting end (111), a threaded hole (112) and a bottom edge. The first connecting end (111) is open and may have an inner thread. The threaded hole (112) may be mounted on the top casing (11). The bottom casing (12) is combined detachably with the top casing (11) and has a second connecting end (121), a connecting shoulder (122), a valve hole (123) and a bottom surface. The second connecting end (121) is open, may have an outer thread and is connected detachably with the first connecting end (111) of the top casing (11). The connecting shoulder (122) is formed around the second connecting end (121) and is combined with the bottom edge of the top casing (11). The valve hole (123) may be threaded and is formed in the bottom surface. The O-ring (13) of the can (10) is mounted between the connecting shoulder (122) and the bottom edge of the top casing (11). The spray nozzle (20) is mounted through the can (10) and has a spray head (21) mounted on the top casing (11) at an end opposite to the first connecting end (111).

The gas filling valve (30) is mounted on the can (10), may be mounted in the valve hole (123) of the bottom surface of the bottom casing (12) and has a first end and a second end. The first end is threaded and is screwed into the valve hole (123) in the bottom casing (12). The second end protrudes from the bottom surface of the bottom casing (12).

Figure 3:
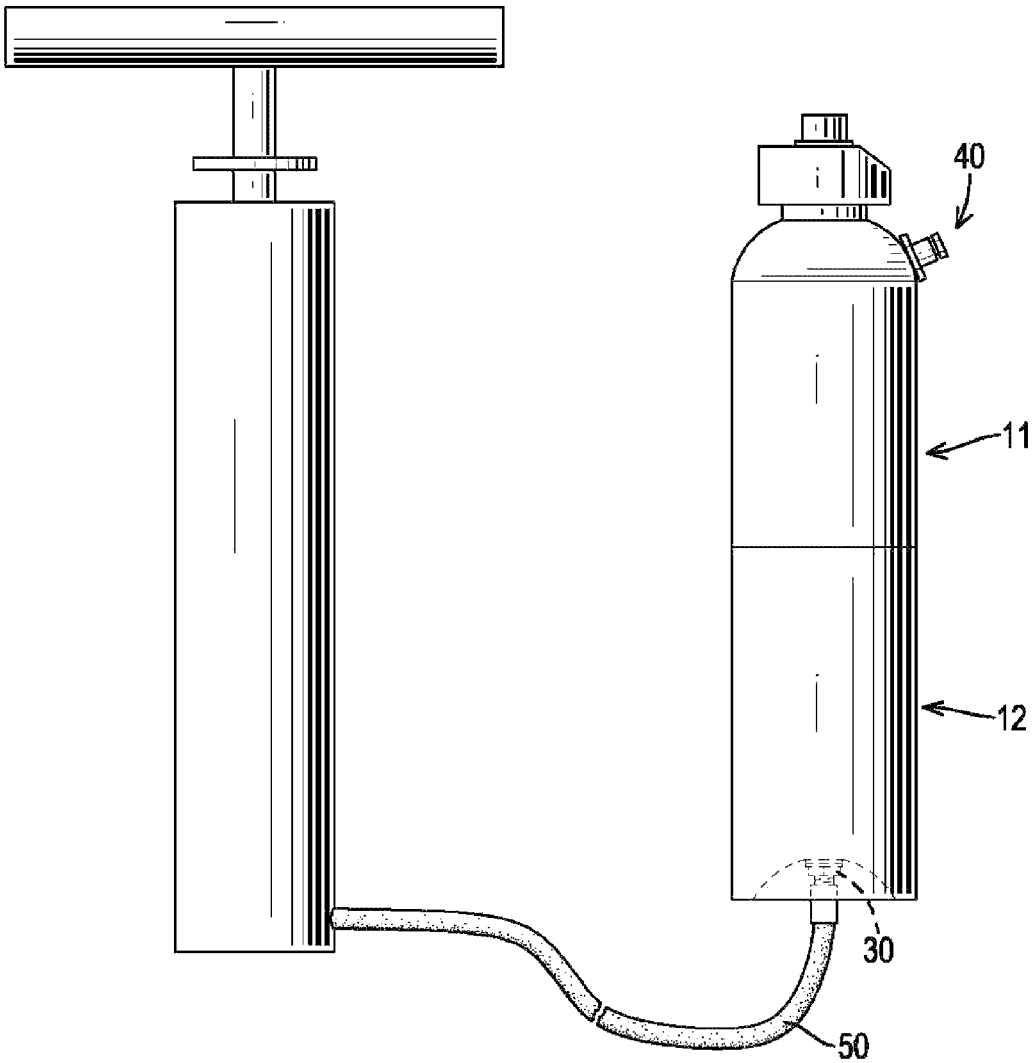
FIG. 3 is an operational side view of the sprayer in FIG. 1.
Figure 4:
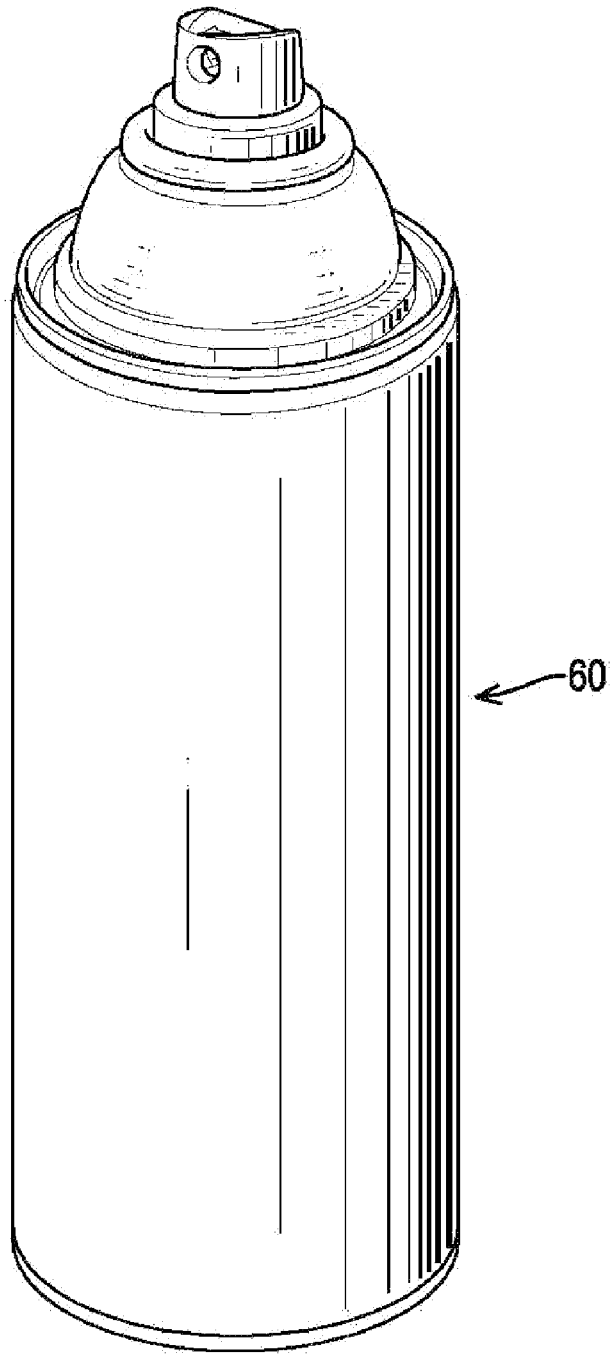
FIG.4 PRIOR ART
FIG. 4 is a perspective view of a conventional sprayer in accordance with the prior art.
Figure 5:
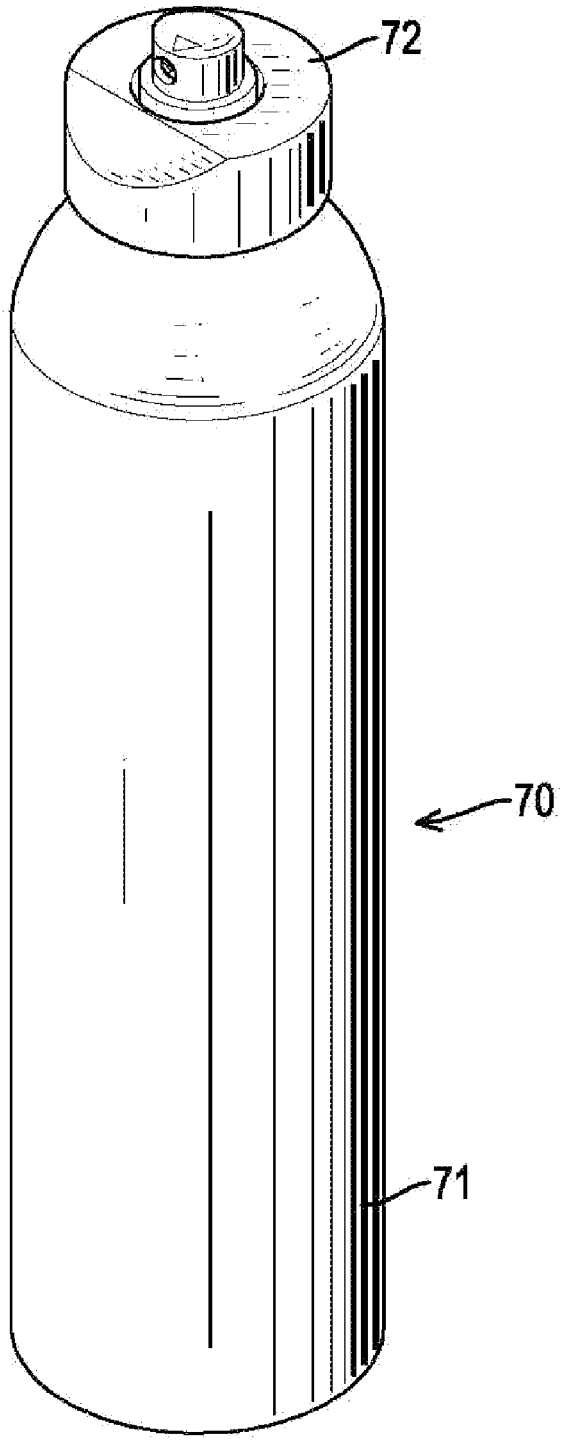
FIG.5 PRIOR ART
FIG. 5 is a perspective view of a sprayer of a conventional refill sprayer assembly in accordance with the prior art.
Figure 6:
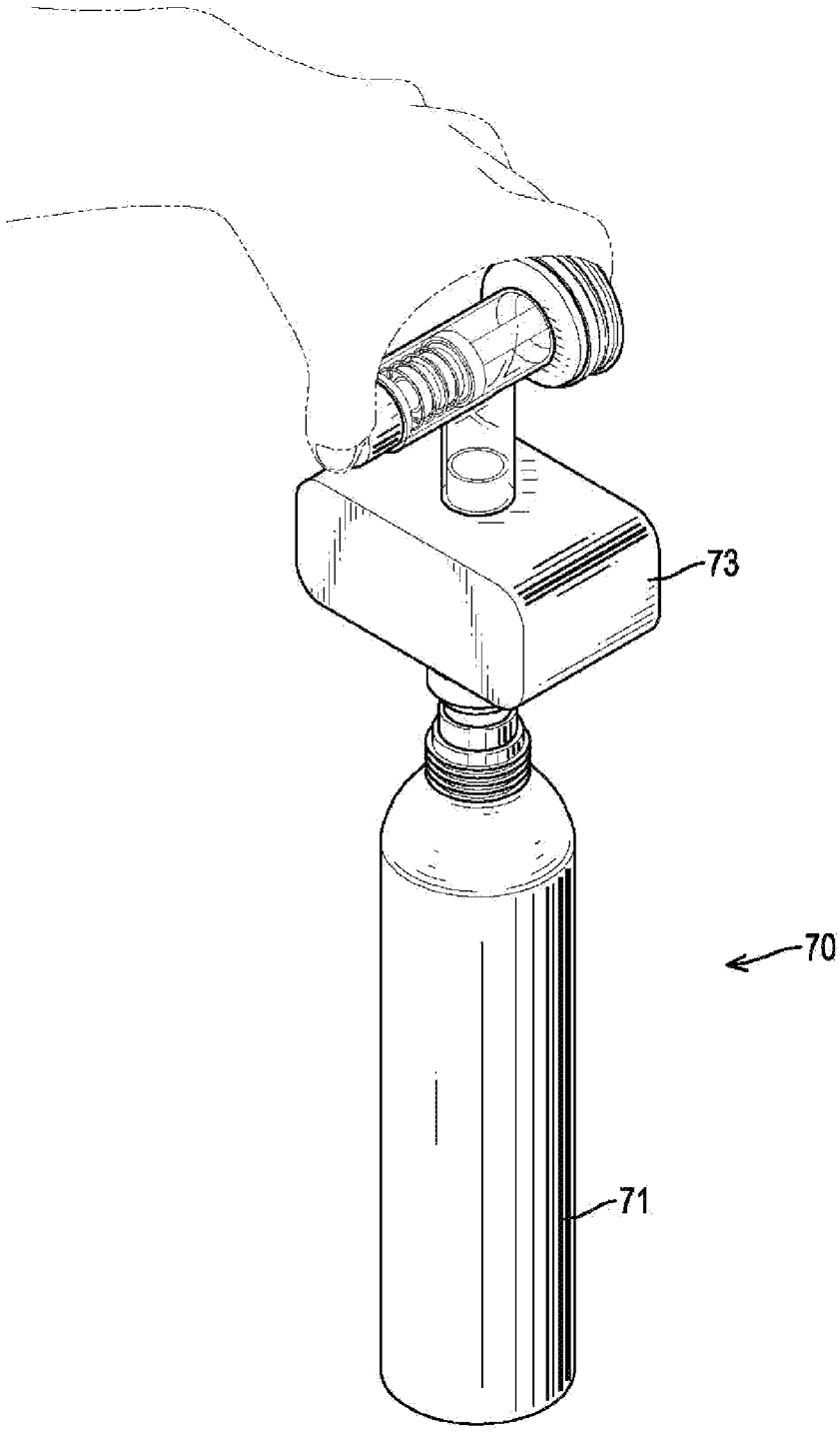
FIG.6 PRIOR ART
FIG. 6 is an operational perspective view of the conventional refillable sprayer assembly in FIG. 5.
Figure 7:
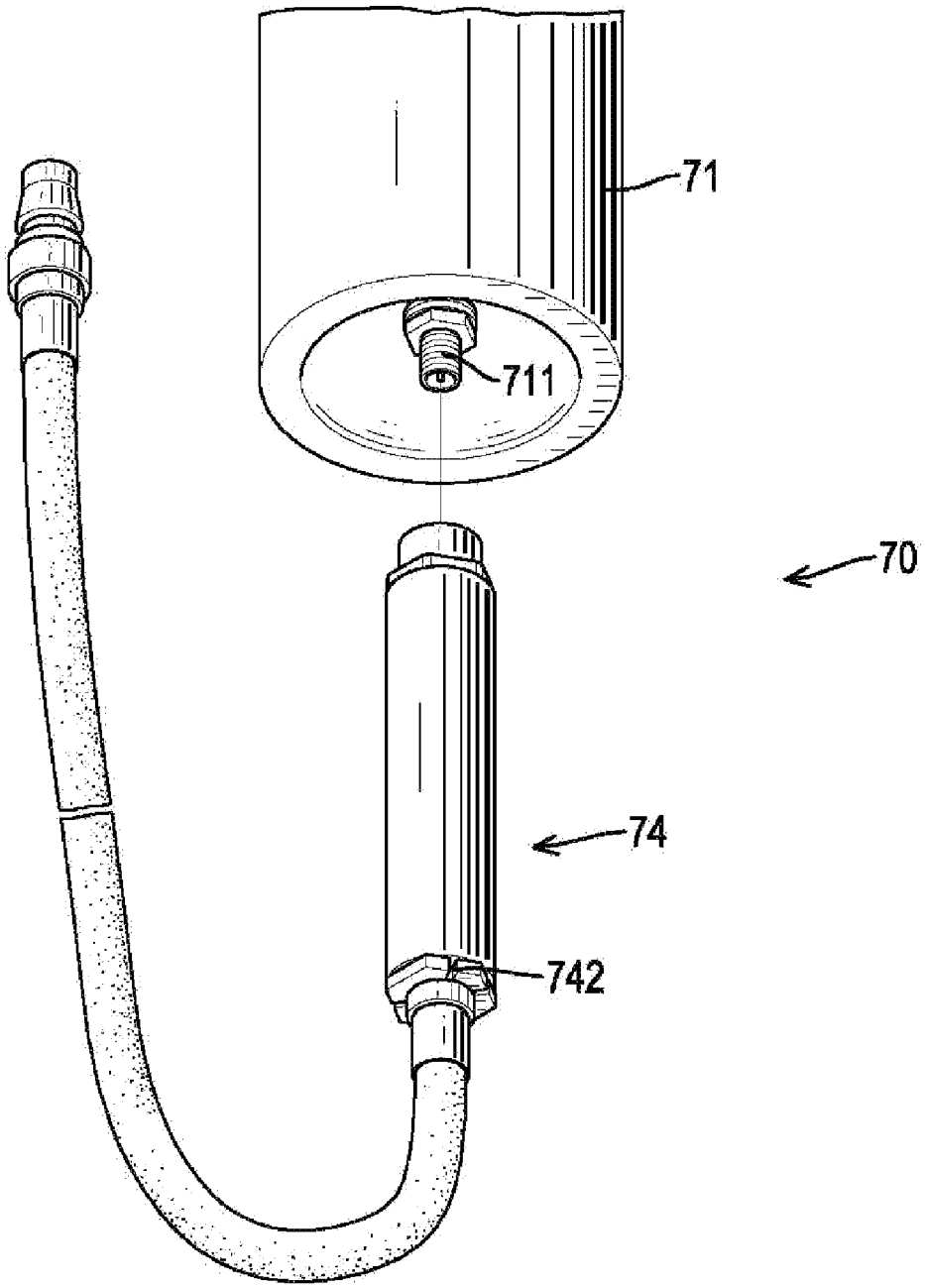
FIG.7 PRIOR ART
FIG. 7 is an operational exploded perspective view of the conventional refillable sprayer assembly in FIG. 5.

The release valve (40) is mounted in and connected to the threaded hole (112) and comprises a screw head (41), two ends, an exhaust control outlet (43), a flange (42) and an O-ring (44). The screw head (41) is mounted on one of the ends of the release valve (40) and is screwed into the threaded hole (112). The exhaust control outlet (43) is mounted on the other end and is opposite to the threaded hole (112), automatically opens when a predetermined pressure is exceed to release excess gas. The flange (42) is mounted between the screw head (41) and the exhaust control outlet (43). The O-ring (44) of the release valve (40) is mounted around the screw head (41) and is mounted between the threaded hole (112) and the flange (42). With further reference to FIG. 3, since the top casing (11) is detachable from the bottom casing (12), oil can be fully added into the bottom casing (12) for filling a fixed volume of the oil into the can (10) and controlling a fixed ratio between the oil and the gas in the can (10). The gas filling valve (30) can be connected to a gas pump by a gas supplying tube (50) to fill pressurized gas into the can (10) by the gas pump. Once a desired pressure level is achieved in the can (10), over-pressurization is prevented by the release valve (40). Therefore, special components for filling the oil and the gas into the can (10) are unnecessary so improving convenience of refilling the sprayer.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A refillable sprayer comprising:

a can being hollow and having a top casing for filling a gas into the can and having a bottom edge, an opened first connecting end and a threaded hole;

a bottom casing combined detachably with the top casing for directly filling a fixed volume of the oil into the can to control a fixed ratio between the oil and the gas in the can and having an opened second connecting end extending into the top casing and combined detachably with the first connecting end of the top casing in a threaded manner and a connecting shoulder formed around the second connecting end and combined with the bottom edge of the top casing; and an O-ring mounted between the connecting shoulder of the bottom casing and the bottom edge of the top casing;

a spray nozzle mounted through the can;

a gas filling valve mounted on the can; and a release valve mounted in and connected to the threaded hole of the top casing of the can and having two ends;

a screw head mounted on one of the ends of the release valve and screwed into the threaded hole;

an exhaust control outlet mounted on the other end opposite to the threaded hole;

a flange mounted between the screw head and the exhaust control outlet; and an O-ring mounted around the screw head and mounted between the threaded hole and the flange.

2. The refillable sprayer as claimed in claim 1, wherein the bottom casing further has a bottom surface; and a valve hole being threaded and formed in the bottom surface, wherein the gas filling valve is mounted in the valve hole.

* * * * *